US005265678A

United States Patent [19]

Grundmann

[11] Patent Number: 5,265,678

[45] Date of Patent: Nov. 30, 1993

[54] METHOD FOR CREATING MULTIPLE RADIAL FRACTURES SURROUNDING A WELLBORE

[75] Inventor: Steven R. Grundmann, Duncan, Okla.

[73] Assignee: Halliburton Company, Duncan, Okla.

[21] Appl. No.: 895,287

[22] Filed: Jun. 10, 1992

[51] Int. Cl.[5] ..... E21B 43/26

[52] U.S. Cl. ..... 166/308

[58] Field of Search ..... 166/297, 308, 299

[56] References Cited

U.S. PATENT DOCUMENTS

| | | | |
|---|---|---|---|
| 3,011,551 | 12/1961 | Young et al. . | |
| 3,100,528 | 2/1961 | Plummer et al. | 166/308 |
| 3,170,517 | 2/1965 | Graham et al. . | |
| 3,200,882 | 11/1961 | Allen | 166/308 |
| 3,517,745 | 6/1970 | Suman, Jr. . | |
| 3,659,652 | 5/1972 | Roberts | 166/308 X |
| 3,718,088 | 2/1973 | Bearden et al. | 166/308 X |
| 3,848,674 | 11/1974 | McColl | 166/308 X |
| 4,903,772 | 2/1990 | Johnson | 166/308 X |
| 5,069,283 | 12/1991 | Mack | 166/308 |

OTHER PUBLICATIONS

Howard et al. "Hydraulic Fracturing", pp. 114–115, SPE Monograph vol. 2, 1970.

*Primary Examiner*—Ramon S. Britts
*Assistant Examiner*—Frank S. Tsay
*Attorney, Agent, or Firm*—Robert A. Kent

[57] ABSTRACT

A method of fracturing a subterranean formation penetrated by a wellbore utilizing high pressure gas. The method is accomplished by casing the well with high strength casing over a selected zone, installing a bridge plug, tubing conveyed perforating gun and packer over a selected zone and filling the casing between the packer and plug with high pressure gas. The gas is present in an amount sufficient to have a pressure of at least about 1.5 times the breakdown pressure of the formation. Upon perforation of the casing the formation is rapidly contacted with the high pressure gas which causes fractures to form in the formation.

16 Claims, 1 Drawing Sheet

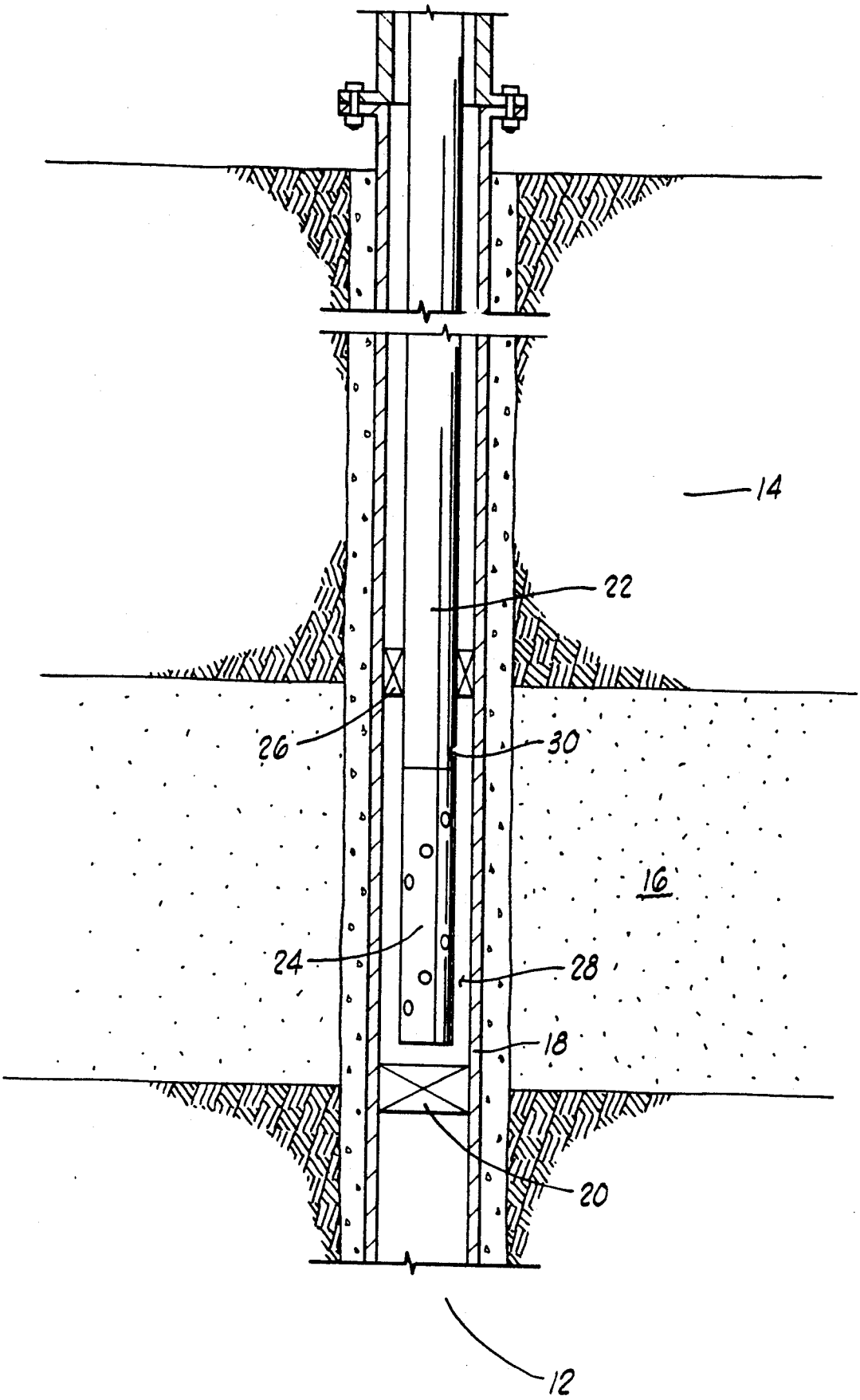
14
22
26
30
16
24
28
18
20
12

METHOD FOR CREATING MULTIPLE RADIAL FRACTURES SURROUNDING A WELLBORE

BACKGROUND OF THE INVENTION

1. Field Of The Invention

The present invention provides a method of producing multiple radial fractures in a subterranean formation surrounding a wellbore which penetrates the formation. The invention is particularly useful in the completion of wells penetrating naturally fractured formations.

2. Brief Description Of The Prior Art

In many types of wells penetrating subterranean formations a casing is placed in the borehole and the casing then is perforated to establish communication between the wellbore and the subterranean formation. The casing typically is cemented in place within the borehole. The formation of perforations in the casing preferably establishes communication through the casing and surrounding cement into the adjacent subterranean formation. It is often desirable to fracture the subterranean formation in order to increase the permeability of the formation in contact with the perforations to thereby facilitate the flow of any hydrocarbons or other fluids present in the formation to the wellbore.

Various methods and apparatus have been used to effect perforation of a well casing and fracturing of a subterranean formation. Perforations have been produced mechanically such as by hydrojetting and through the use of explosive charges such as in jet perforating. Fracturing has been accomplished by introducing an aqueous or hydrocarbon liquid into the formation through the perforations at a rate and pressure sufficient to fracture the subterranean formation. In some instances, the fracturing fluid may include a propping agent to prop the created fracture open upon completion of the fracturing treatment. The propped fracture provides an open channel through which fluids may pass from the formation to the wellbore.

SUMMARY OF THE INVENTION

The present invention provides an improved method of producing multiple fractures in a subterranean formation penetrated by a wellbore. The method is accomplished in part, by the use of high pressure gas, such as nitrogen, that is placed within the wellbore. During casing of the wellbore, a high strength casing is positioned through a selected portion of a subterranean formation. The casing may be cemented in place within the borehole. A seal then is effected at the lower end of the high strength casing such as placement of a mechanical bridge plug or packer. A tubing conveyed or wireline jet perforating apparatus then can be lowered into the hole and a second packer is set above the perforating apparatus in the casing in the selected portion of the formation which is to be perforated. A gas then is introduced into the casing between the packers in an amount sufficient to achieve a pressure within the casing of at least about 1.5 times the breakdown pressure of the subterranean formation. The gas preferably is pressurized to at least about 2 times the breakdown pressure and most preferably at least 2.5 times the breakdown pressure of the formation. After pressurization of the casing, the perforating guns are actuated to perforate the casing and any cement sheath surrounding the casing. The explosive detonation of the jet perforating apparatus in association with the high peak pressure exerted by the gas in the casing upon the formation creates multiple fractures in the formation. The extent of fracture propagation depends upon the pressure of the gas and the storage volume of the casing, as well as the number of perforations.

BRIEF DESCRIPTION OF THE DRAWINGS

FIG. 1 is a schematic sectional view of a well in which the present invention is practiced.

DESCRIPTION OF THE PREFERRED EMBODIMENT

Referring to FIG. 1, there is shown a wellbore 12 extending through overlying earth formation 14 into communication with a desired zone or formation 16. Formation 16 may contain hydrocarbons or other fluids that it would be desirable to recover through said wellbore 12. Formation 16 may contain numerous natural fractures. Wellbore 12 preferably is cased with a high strength casing 18 where it penetrates formation 16. The entire casing within wellbore 12 does not need to be of the high strength type. The phrase "high strength casing" as used herein is intended to mean casing capable of withstanding internal pressure equal to at least 2 times the breakdown pressure of the subterranean formation in which it is present. The casing 18 is cemented at its upper end and may be cemented through at least a portion of formation 16. A packer or other suitable plugging device or composition 20 is placed in the lower portion of casing 18 within formation 16 or immediately below the formation to minimize potential contamination or communication between the fluids in formation 16 and other formations after perforation of the wellbore. The packer 20 functions to seal one end of casing 18 against fluid flow. A tubing string 22 having a perforating gun 24 attached thereto, preferably is positioned within casing 18, such that the perforating gun is adjacent to at least a portion of formation 16. A second packer 26 is positioned in an upper portion of casing 18 surrounding tubing string 22 to define a chamber 28 which is capable of holding pressure. A gas, such as for example nitrogen, then is introduced through tubing 22 into chamber 28 by passage through a port 30 in tubing string 22. The gas is supplied to the wellhead at the earth surface through equipment that is conventional and not illustrated. The gas may comprise, for example, methane, argon, air, carbon dioxide, mixtures of gases or substantially any other gas that does not adversely react with the formation or equipment which it contacts. The gas is introduced into chamber 28 in an amount sufficient to cause a pressure within the chamber 28 of at least about 1.5 times the breakdown pressure of formation 16. Most preferably the chamber 28 is pressurized to a level of at least about 2 times the breakdown pressure of formation 16 and most preferably at least about 2.5 times the breakdown pressure. The breakdown pressure of formation 16 is that pressure which must be applied to the formation to cause the formation of a fracture therein. This pressure will vary with differing earth formations and can differ at different depths even in the same formation. The breakdown pressure of a particular formation can be readily determined or estimated by any of the various well known techniques. It is to be understood, since the pressure in chamber 28 is at least 1.5 times the breakdown pressure, that estimated values based upon mathematical models of formation behavior may be utilized in the practice of the present invention. The high strength casing 18 should be selected such that it is capable of withstanding the pressure of the gas without undesired rupturing. The selection of such casing is well within the ordinary experience of individuals in the art.

Once the desired pressure level is achieved within chamber 28, perforating gun 24 is actuated to create a series of perforations in casing 18 which penetrate the cement sheath surrounding the casing 18. The jet charges in the perforating gun create a perforation in the casing while substantially simultaneously exposing the formation to the elevated pressure of the gas in chamber 28. The sudden application of the elevated gas pressure to the formation 16 results in numerous fractures being created in the formation. When perforations are created in a circumferential or spiral pattern about casing 18 the fractures will radiate from casing 18 into formation 16. The radial formation of fractures is particularly desirable when the formation 16 contains natural fractures. Generally, hydraulic fracturing techniques generate fractures in a subterranean formation in the direction of the least principal horizontal stress. In naturally fractured formations, the natural fractures also have been found to be in the direction of the least principal horizontal stress. Thus hydraulic fractures created in a naturally fractured formation tend to be parallel to the natural fractures. The basic inability of a hydraulic fracture to intersect the natural fractures limits the flow of hydrocarbons or other fluids that could be recovered from the formation. The present invention provides a means to connect multiple nature fractures to a wellbore through a radial fracturing pattern to thereby significantly increase the potential flow of fluids to a wellbore.

The length of the fracture created by the method of the present invention will depend upon the breakdown pressure, stored gas pressure and volume of the gas present in chamber 28. Fractures that are initiated from the perforations will continue to grow outwardly from the wellbore until the pressure level of the gas in the created fracture falls to about the pressure equivalent to the maximum principal horizontal stress of the subterranean formation. If desired, the pressure within chamber 28 can be monitored and when the pressure begins to decline, following perforation of casing 18, additional gas can be introduced through tubing 22 at a rate and pressure sufficient to continue propagation of the created fractures. Such continued fracturing may result in the intersection of multiple natural fractures thereby further increasing the potential for fluid production from formation 16.

The effectiveness of the fracturing process also can be increased by orienting the perforating charges in a manner that spaces or positions the charges approximately 180 degrees apart and in the most preferred direction to intersect any natural fractures that are present in the formation. Methods to achieve oriented perforating are well known in the art and therefor no further description of such techniques are considered necessary since such orientation does not comprise a part of the present invention.

To further illustrate the present invention and not by way of limitation, the following example is provided.

EXAMPLE

A well drilled in the Devonian Shale requires fracture stimulation to be economically productive. Production occurs through natural fractures in the formation. The natural fractures generally run in a direction parallel to the fault system within the shale and many are less than 10 feet apart. The preferred direction to fracture the formation is perpendicular to the existing natural fractures to maximize potential production.

A well is drilled to a depth of 4250 feet. The zone to be stimulated is between 4025 and 4075 feet. The production casing is 4½ inches outside diameter with a weight of 11.6 #/ft and an API Grade of P-110, set from 3920 to 4190 feet and the remainder being 9.5 #/ft., API Grade J-55 casing. The casing is cemented in place within the wellbore. Fluid within the wellbore is displaced with nitrogen gas. A bridge plug is set at 4175 feet. A tubing conveyed perforating tool with a pressure activated fuse is spaced 100 feet below a packer. The packer is run on 23/8" 5.8 #/ft. N-80 tubing and is set within the casing at 3925 feet. The perforating tool has charges spaced at 90 degrees and will produce 4 shots per foot over a 50 foot distance.

The breakdown pressure is approximately 3200 psi at the zone to be perforated. The pressure activated fuse is set for 9600 psi which is approximately three times the breakdown pressure. Nitrogen gas is pumped down the tubing and into the isolated zone within the casing until the gas pressure activates the firing mechanism in the perforating gun and the casing is perforated. As the perforations are formed the nitrogen gas escapes through the perforations and fractures the formation. The fractures continue to grow in the direction induced by the perforation until the gas pressure drops below the breakdown pressure. The fractures are calculated to extend 10 to 20 feet from the wellbore and thereby intersect the natural fractures in the formation. The tubing, packer, perforating gun and bridge plug then may be removed from the wellbore and the well placed on production.

While that which currently is considered to be the best mode of the invention has been described herein, it is to be understood that changes or modifications can be made in the process or equipment without departing from the spirit or scope of the invention as set forth in the appended claims:

What is claimed is:

1. A method of fracturing a subterranean formation penetrated by a wellbore comprising:

positioning high strength casing within a selected zone of said wellbore;

positioning a means for plugging said casing at a selected lower end;

positioning a means for perforating said high strength casing within said casing together with a means for introducing a gas into said casing;

positioning a means for sealing the said casing at a selected upper end above said means for perforating and said means for gas introduction thereby creating a chamber;

introducing a gas into said casing in an amount sufficient to increase the pressure within said chamber to at least 1.5 times the breakdown pressure of the selected zone of said subterranean formation; and perforating means and substantially simultaneously fracturing said selected zone of said subterranean formation by exposure of said formation to said pressurized gas.

2. The method of claim 1 wherein said plugging means is a bridge plug.

3. The method of claim 1 wherein said upper sealing means is a packer.

4. The method of claim 1 wherein said perforating means is a tubing conveyed jet perforating gun.

5. The method of claim 4 wherein said means for gas introduction is tubing positioned within said casing which is connected to said perforating gun.

6. The method of claim 1 wherein the gas is nitrogen or air.

7. The method of claim 1 wherein the gas is present in an amount sufficient to increase the pressure to at least about 2 times the breakdown pressure.

8. A method of fracturing a subterranean formation penetrated by a wellbore comprising:

cementing high strength casing within a selected zone of said wellbore;

positioning a bridge plug at a lower end of said high strength casing;

positioning tubing within said high strength casing, said tubing having a perforating gun attached to the lower end of said tubing;

positioning a packer at an upper end of said high strength casing creating a seal between said tubing and said casing to thereby creating a chamber;

introducing a gas through said tubing and into said chamber in an amount sufficient to increase the pressure within said chamber to at least 1.5 times the breakdown pressure of the selected zone; and perforating said casing and substantially simultaneously fracturing said formation by exposure of said formation to said high pressure gas through said perforations.

9. The method of claim 8 wherein the gas is nitrogen or air.

10. The method of claim 8 wherein the gas pressure is at least about 2 times the breakdown pressure.

11. The method of claim 8 wherein the gas pressure is at least about 2.5 times the breakdown pressure.

12. The method of claim 8 wherein said perforating gun contains explosive jet charges arranged in a spiral pattern whereby a radial pattern of fractures are created upon fracturing of the subterranean formation.

13. A method of forming a radial fracture pattern from a wellbore penetrating a subterranean formation comprising:

positioning high strength casing within a selected zone of said wellbore;

positioning a bridge plug at a lower end of said high strength casing and sealing said casing with said plug;

positioning tubing within said high strength casing, said tubing having a perforating gun attached thereto containing explosive jet charges arranged in a spiral pattern in said gun;

positioning a packer at an upper end of said high strength casing creating a seal between said tubing and said high strength casing to thereby create a chamber;

introducing a gas through said tubing and into said chamber in an amount sufficient to increase the pressure within said chamber to at least about 1.5 times the breakdown pressure of said selected zone of said wellbore;

activating said perforating gun to create perforations in said high strength casing; and fracturing said subterranean formation to form a radial fracture pattern by applying the gas pressure to said formation through said created perforations substantially simultaneously with creation of said perforations.

14. The method of claim 13 wherein said gas is nitrogen or air.

15. The method of claim 13 wherein said gas pressure is at least about 2 times the breakdown pressure.

16. The method of claim 13 wherein said gas pressure is at least 2.5 times the breakdown pressure.

* * * * *